United States Patent [19]

Limbach

[11] Patent Number: 4,760,654

[45] Date of Patent: Aug. 2, 1988

[54] APPARATUS FOR LOCATING AN ORTHOTIC IN A SKI BOOT SHELL

[76] Inventor: Robert C. Limbach, 49 Bellevue, Belvedere, Calif. 94920

[21] Appl. No.: 872,261

[22] Filed: Jun. 9, 1986

Related U.S. Application Data

[63] Continuation-in-part of Ser. No. 807,272, Dec. 10, 1985, Pat. No. 4,665,576, which is a continuation-in-part of Ser. No. 645,507, Aug. 30, 1984, Pat. No. 4,567,617.

[51] Int. Cl.[4] ..... A43B 5/04; A43B 13/38

[52] U.S. Cl. ..... 36/117; 36/43

[58] Field of Search ..... 36/119, 88, 93, 117, 36/43, 44, 71, 118, 120, 121

[56] References Cited

U.S. PATENT DOCUMENTS

| | | | |
|---|---|---|---|
| 3,878,626 | 4/1975 | Isman | 36/15 |
| 4,253,251 | 3/1981 | Saloman | 36/119 |
| 4,420,893 | 12/1983 | Stephan | 36/117 |
| 4,510,703 | 4/1985 | Eiteljorg | 36/119 |
| 4,534,122 | 8/1985 | MacPhail | 36/119 |
| 4,557,061 | 12/1985 | Graillat et al. | 36/119 |
| 4,567,617 | 2/1986 | Limbach | 12/142 P |

FOREIGN PATENT DOCUMENTS

| | | | |
|---|---|---|---|
| 2005365 | 9/1970 | Fed. Rep. of Germany | 36/119 |
| 706305 | 3/1931 | France | 36/15 |

*Primary Examiner*—Henry S. Jaudon
*Assistant Examiner*—Steven N. Meyers
*Attorney, Agent, or Firm*—Limbach, Limbach & Sutton

[57] ABSTRACT

A ski boot is provided with indexing means for accurately locating an orthotic in the boot.

1 Claim, 1 Drawing Sheet

APPARATUS FOR LOCATING AN ORTHOTIC IN A SKI BOOT SHELL

BACKGROUND OF THE INVENTION

This application is a continuation-in-part of my copending application, Ser. No. 807,272 filed Dec. 10, 1985, now U.S. Pat. No. 4,665,576 which was in turn a continuation-in-part of my application Ser. No. 645,507 filed Aug. 30, 1984 which is now U.S. Pat. No. 4,567,617 issued Feb. 4, 1986.

My 1986 patent discloses a method of aligning ski boots in which the correct stance of a skier in relation to the boots is first recorded with the skier standing on an orthotic in the empty shells of the boots with the boot bladders removed. Then the bladders are replaced in the boots and the boots are tightened, and the boots are adjusted to provide the same stance that was recorded before, thereby compensating for distortion of the stance which may be introduced by tightening the boots on the bladder and the skier's foot and lower leg. The stance adjustment can be made in a variety of ways, for instance by removing a wedge from the boot sole or by manipulating a canting adjustment built into the boot.

My 1985 application discloses a structure which permits the stance adjustment to be made by positioning wedge shaped innersoles in the ski boots.

This application addresses a problem which may be encountered in using either of my earlier inventions. Thus, when the bladder is removed from the boot and the skier's stance is to be recorded in the empty boot shells, it is necessary to locate the skier's orthotics properly in the shells, and this may be difficult because the removal of the bladders leaves enough room in the boot shells that the orthotics and the skier's feet can move around in the shells. While the problem can be overcome by carefully positioning the orthotics and the skier's feet in the boot or by attaching the orthotics to the shells with double stick tape, it is desirable to simplify this procedure and make it more accurate.

Additionally, it is desirable to provide a boot design which facilitates use of the method of my patent particularly where the boots may be designed with a special footbed or innersole which provides the function of the orthotic disclosed in my patent.

SUMMARY OF THE INVENTION

In accordance with this invention I provide an index means between the orthotic and the inside bottom of the shell for properly locating the orthotic in the shell when the bladder is removed. The index means preferably comprises one or more protrusions on the orthotic and mating sockets in the boot shell, or the reverse by which the orthotic is accurately and removably located in the shell when the bladder is removed. The protrusions and sockets can be on the bottom of the orthotic and top of the sole of the shell or on the front and back of the orthotic and the toe and heel of the shell.

Where the boot has a removable boot sole filler below the bladder, the part of the indexing in the shell is preferably formed in the ski boot sole filler. Preferably this is done by making the ski boot sole filler as a removable rigid torsion box of Kevlar or the like with its top open and filled with a shock and vibration absorbing material such as silicone rubber. Provision of indexing sockets in the rubber part of such a ski boot sole filler provides effective indexing of the orthotic in the shell, while the rubber helps absorb the shape of a protrusion on the orthotic after the bladder is placed back in the boot with the orthotic in the bladder. The ski boot sole filler surface could be manufactured so that it is flat providing a sound foundation within the boot shell. A ski boot sole filler with a system of dampening pad inset into a torsion box without a top and comprised of a bottom and sidewalls made of stretch resistant material such as Kevlar or carbon fiber.

The indexing means for the shell and orthotic can be pre-formed in the manufacture of the boot by molding them in the shell (or the ski boot sole filler) and in the orthotic, and the term orthotic is used herein to include special insoles designed for boots to provide effective footbeds with heel pockets, arch support, toe crests, etc. Alternately, the indexing means can be provided on an attachment for the boot and orthotic which are not originally made for each other, and in either case a protrusion part of the indexing means can be removable from the boot after recording the skier's stance in the shell so that the protrusion does not remain between the orthotic and the ski boot sole filler. Removal can be accomplished by removing a protrusion which has been mounted by adhesive or by breaking or cutting away a protrusion which was originally molded into the shell or orthotic.

Where the indexing means is provided for use with boots and orthotics not originally designed for each other, I prefer to make the indexing means as one or more protrusions to be adhesively mounted on the bottom of an orthotic, preferably with a center line premarked on the orthotic for proper location with the sockets provided in the shell by drilling holes in the ski boot sole filler usually provided as a removable part of the shell, using a specially prepared template.

Preferably the indexing means provides accurate longitudinal and lateral alignment of the orthotic so that the center line of the foot lies along the center line of the boot because this is important to the accuracy of the method of my patent. Less time and skill is required in locating the orthotic in the boot because the protrusion indexing system allows the technician to accurately position the orthotic in the boot shell. The accurate longitudinal and lateral alignment is preferably provided by a pair of removable pins on the bottom of the orthotic under the heel and ball of the foot with corresponding holes in shell, but a single rib down the center of the bottom of the orthotic and corresponding slot in the shell may suffice.

Finally, where it is desirable, the bottom of the boot bladder can be perforated or provided with matching indexing means so that the orthotic indexes to the bladder and the bladder indexes in the same way to the shell or the indexing means of the orthotic and shell connect through the bladder. In this way, the orthotic can be locked in the same orientation during skiing that is occupied when the skier's stance was pre-recorded and re-adjusted.

These and other features of the invention will be apparent from the following description of a preferred embodiment, it being understood that a wide variety of alternatives can be employed for indexing in accordance with the invention.

DETAILED DESCRIPTION OF THE INVENTION

Figure 1:
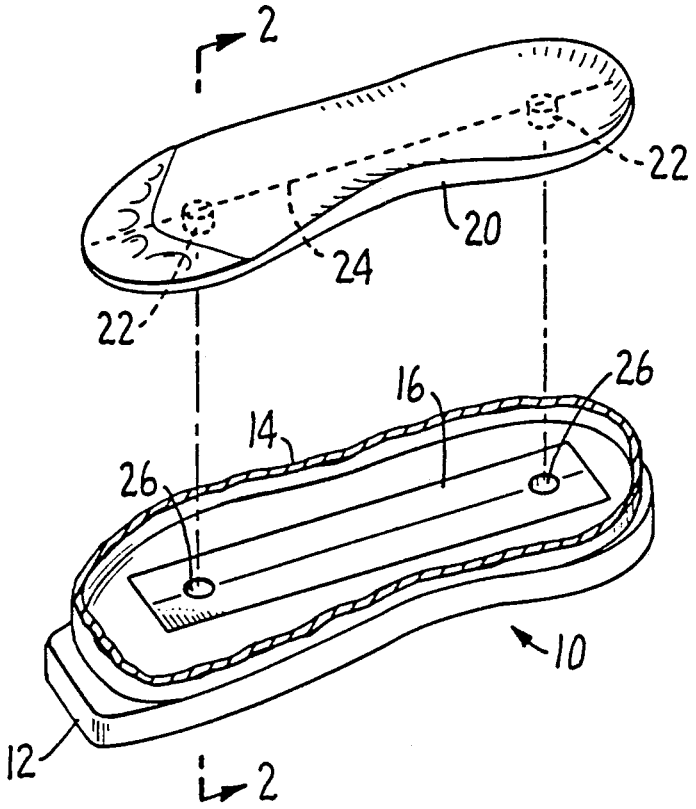
Figure 3:
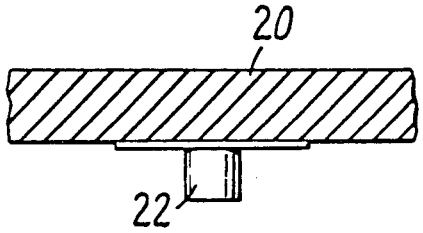
Figure 2:
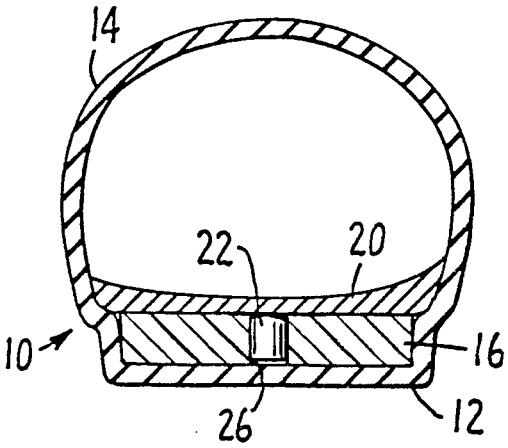
Figure 4:
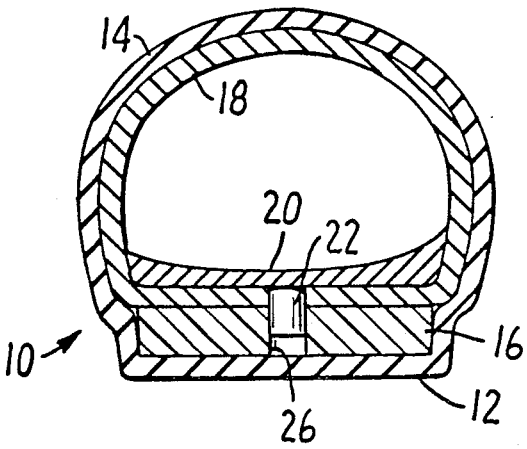

FIG. 1 is a perspective view, broken away, with the parts exploded showing the sole of a boot shell and orthotic constructed in accordance with the invention, FIG. 2 is a sectional view showing the orthotic and shell assembled for pre-recording the skier's stance, FIG. 3 is an enlarged view showing the indexing protrusion on the bottom of the orthotic, and FIG. 4 is a sectional view of the orthotic, bladder and shell assembled as they are designed to be worn by the skier.

Referring now in detail to the drawing, the boot is shown as a molded plastic shell 10 having a sole 12, sidewalls 14, and a ski boot sole filler 16. A bladder 18 (FIG. 4) is provided in the shell 10 and an insole orthotic 20 inside the bladder.

In this form of my invention the indexing means between the shell 10 and orthotic 20 is provided by a pair of protrusions 22 adhesively mounted on the bottom of the orthotic 20 along a prescribed center line 24 and aligned with holes 26 drilled in the boot sole filler 16.

The orthotic is removably mounted in the bladder so as to be completely surrounded thereby with the bladder positioned between the orthotic and the shell to such an extent that the bladder cannot be removed from the shell without also removing the orthotic from the shell. The protrusion 22 and holes 26 together provide indexing means for aligning the orthotic and the shell.

With the indexing means in place as shown in FIGS. 1–3 the orthotic is accurately aligned with the shell to pre-record the stance of the skier's leg with respect to the boot. Thereafter the protrusion 22 can be removed from the orthotic (or left attached if the bladder is apertured) and the boot assembled in its intended manner of use as shown in FIG. 4, and the boot can be adjusted to re-establish the pre-recorded stance.

The skier's initial stance is preferably recorded with plumb-bobs as explained in my patent, and the boots can be re-adjusted to re-establish the recorded stance by removing wedges from the sole of the boot, manipulating the canting adjustment, manipulating wedges between the ski and the binding interface, and/or manipulating innersole wedges as disclosed in my application.

I claim:

1. A ski boot comprising a shell; a bladder removably mounted in the shell; an orthotic removably mounted in the bladder so as to be completely surrounded thereby and with said bladder positioned between the orthotic and the shell to such an extent that the bladder cannot be removed from the shell without also removing the orthotic from the shell; and indexing means on the orthotic and the shell; said indexing means being in alignment and adapted to engage with each other.

* * * * *